US010487818B2

(12) United States Patent
Bilousov et al.

(10) Patent No.: US 10,487,818 B2
(45) Date of Patent: Nov. 26, 2019

(54) HYDRAULICALLY DRIVEN BELLOWS PUMP

(71) Applicant: GARNIMAN S.A., Montevideo (UY)

(72) Inventors: Anatoliy Bilousov, Slavjanska (UA); Jorg Rothenbuhler, Borex (CH)

( * ) Notice: Subject to any disclaimer, the term of this patent is extended or adjusted under 35 U.S.C. 154(b) by 415 days.

(21) Appl. No.: 15/119,180

(22) PCT Filed: Feb. 23, 2015

(86) PCT No.: PCT/EP2015/053714

§ 371 (c)(1),
(2) Date: Aug. 16, 2016

(87) PCT Pub. No.: WO2015/128283

PCT Pub. Date: Sep. 3, 2015

(65) Prior Publication Data

US 2017/0009761 A1 Jan. 12, 2017

(30) Foreign Application Priority Data

Feb. 26, 2014 (EP) ..... 14156813
Mar. 20, 2014 (EP) ..... 14160908

(51) Int. Cl.
*F04B 43/107* (2006.01)
*F04B 1/02* (2006.01)
(Continued)

(52) U.S. Cl.
CPC ..... *F04B 43/107* (2013.01); *F04B 1/02* (2013.01); *F04B 9/105* (2013.01); *F04B 43/10* (2013.01);
(Continued)

(58) Field of Classification Search
CPC ..... F04B 43/107; F04B 43/10; F04B 45/02; F04B 9/105; F04B 43/1136; F04B 43/113;
(Continued)

(56) References Cited

U.S. PATENT DOCUMENTS 2,464,095 A 3/1949 Nies
3,524,714 A * 8/1970 Grove ..... F04B 43/1136 417/345
(Continued)

FOREIGN PATENT DOCUMENTS

DE 1653445 7/1971
DE 3233438 3/1984
EP 0419695 4/1991

*Primary Examiner* — Dominick L Plakkoottam

(57) ABSTRACT

A hydraulically driven diaphragm pumping machine ("pump"), in particular for water and difficult-to-pump materials, comprises at least two side-by-side pumping units. Each pumping unit comprises a hydraulically-driven pump cylinder (1,2) and a separate non-pump hydraulic drive cylinder (9,10). The pump cylinder (1,2) has a lower first end with a first inlet and outlet for fluid to be pumped and an upper second end with a second inlet and outlet for hydraulic fluid. The pump cylinder (1,2) contains a bellows (3,4) closed at its lower end and open at its upper end for communication with hydraulic fluid. The outside of the bellows (3,4) defines a space for fluid to be pumped. The bellows (3,4) of the pump cylinder (1,2) is arranged to be driven by hydraulic fluid supplied at its top end, in concertina like expansion and contraction to pump the fluid to be pumped adjacent the lower first end of the pump cylinder (1,2). The hydraulic drive cylinder (9,10) is placed side-by-side the pump cylinder (1,2). The hydraulic drive cylinder (9,10) has a lower first end associated with a hydraulic drive an upper second end containing hydraulic fluid communicating with the upper second end of the pump cylinder (1,2). The hydraulic drive terminates at its upper end with a drive piston (19,20) slidably mounted in the hydraulic drive cylinder (9,10). The hydraulic drives of the hydraulic drive cylinders (9,10) of the two pumping units are connected by a hydro-mechanical connection (25,27) designed to control
(Continued)

drive of the hydraulic fluid to advance and retract the pistons (19,20) of each hydraulic drive cylinder (9,10).

7 Claims, 5 Drawing Sheets

(51) Int. Cl.

| | |
|---|---|
| ***F04B 53/10*** | (2006.01) |
| ***F04B 45/02*** | (2006.01) |
| ***F04B 43/10*** | (2006.01) |
| ***F04B 45/033*** | (2006.01) |
| ***F04B 45/053*** | (2006.01) |
| ***F04B 9/105*** | (2006.01) |
| ***F04B 43/113*** | (2006.01) |

(52) U.S. Cl.
CPC ..... *F04B 43/113* (2013.01); *F04B 43/1136* (2013.01); *F04B 45/02* (2013.01); *F04B 45/022* (2013.01); *F04B 45/0336* (2013.01); *F04B 45/053* (2013.01); *F04B 53/10* (2013.01)

(58) Field of Classification Search
CPC ..... F04B 43/1133; F04B 45/022; F04Bql 45/0336; F04B 45/053
See application file for complete search history.

(56) References Cited

U.S. PATENT DOCUMENTS

| | | | | |
|---|---|---|---|---|
| 4,044,558 | A * | 8/1977 | Benson | F02G 1/0435 60/520 |
| 5,220,943 | A * | 6/1993 | Zink | B67D 7/02 137/347 |
| 5,308,230 | A * | 5/1994 | Moore | F04B 43/1136 417/394 |
| 6,419,462 | B1 * | 7/2002 | Horie | F04B 13/00 417/394 |
| 8,096,785 | B2 | 1/2012 | Eysymontt | |
| 8,591,201 | B2 | 11/2013 | Eysymontt | |
| 9,518,577 | B2 * | 12/2016 | van Boeyen et al. | F04B 19/24 |
| 2004/0050255 | A1 * | 3/2004 | Simonds | B01D 53/0415 96/109 |
| 2009/0060764 | A1 * | 3/2009 | Mitzlaff | A61B 17/3203 417/460 |
| 2010/0278669 | A1 * | 11/2010 | West | F04B 43/113 417/521 |
| 2011/0020150 | A1 * | 1/2011 | Eysymontt | F04B 9/105 417/321 |
| 2011/0189029 | A1 * | 8/2011 | Van De Velde | F04B 43/06 417/53 |
| 2014/0271252 | A1 * | 9/2014 | Vines | F04B 49/22 417/53 |

* cited by examiner

HYDRAULICALLY DRIVEN BELLOWS PUMP

FIELD OF THE INVENTION

The invention relates to hydraulically driven machines, in particular for pumping water and difficult-to-pump fluid materials, like fine minerals and ores, sludges, suspensions, fluid, slurries, gels and other viscous materials. These pumping machines may be referred to herein simply as pumps or machines.

BACKGROUND OF THE INVENTION

Conventional pumping machines that can be used for difficult-to-pump materials have displacement organs such as pistons, plungers, peristaltic hoses etc. However such displacement organs are subject to frictional wear and the drive of the machine is not properly isolated from the pumped material.

U.S. Pat. No. 8,096,785 discloses a hydraulically driven multicylinder diaphragm pumping machine, in particular for pumping difficult-to-pump materials. This pumping machine comprises a plurality of pump cylinders each having one end with an inlet and outlet for fluid to be pumped and another end with an inlet and outlet for hydraulic fluid. These inlets and outlets can be a separate inlet and outlet (for the hydraulic fluid) or a combined inlet/outlet (for the fluid material being pumped). The inlets and outlets are associated with respective inlet and outlet valves.

In such machines, a separator is located inside and is movable to-and-fro along each pump cylinder. The movable separator has one side facing the pumped-material end of the cylinder and another side facing the hydraulic-fluid end of the cylinder. This movable separator is connected to the inside of the pumped-material end of the cylinder by a first flexible diaphragm in the form of a concertina-like bellows that is expandable and contractable inside the cylinder along the length direction of the cylinder as the movable separator moves to-and-fro along the cylinder. The movable separator delimits a first chamber inside the first bellows-like flexible diaphragm for containing a variable volume of pumped fluid in communication via the inlet and outlet with a pumped fluid manifold and circuit. The movable separator is connected also to the inside of the second end of the cylinder by a second flexible diaphragm in the form of a concertina-like bellows that is contractable and expandable along the length direction of the cylinder in correspondence with expansion and contraction of the first flexible diaphragm. The second side of the movable separator delimits a second chamber inside the second expandable and contractable diaphragm for containing a variable volume of hydraulic fluid in communication with the second inlet and outlet. An annular space is defined between the outside of the first and second diaphragms and the inner wall of the pump cylinder which annular space in use contains a fluid that is the same as said hydraulic fluid or has similar hydraulic characteristics.

This double bellows pumping machine is directly driven by a hydraulic pump drive, greatly simplifying the machine and providing simple means of variation and control of the flow of the pumped fluid delivered. Moreover, the double diaphragm arrangement provides a double protection of the pumped fluid from the pumping fluid.

Supplemental research with such machines demonstrated that various aspects such as the reliability of the operation of the bellows-like diaphragm could be improved, which led to the improved double-bellows pump described in U.S. Pat. No. 8,591,201.

Experience with these two-bellows pumps has shown that they provide excellent pumping characteristics notably a smooth pumping action; however in case of puncture of a bellows its replacement requires a substantial overhaul of the machine that can take a day or more.

Furthermore, conventional positive displacement pumps designed for use in oilfields and off-shore platforms have numerous drawbacks. First, they have many mechanical moving parts, causing wear and tear, heat and friction. Moreover, most conventional pumps are too large to be easily transported on a truck and are not built to work under classified conditions. Conventional pumps also result in vibrational premature valve wear and packing/sealing problems. Most pumps are too heavy to transport around the oilfields and off-shore platforms. Conventional pumps operate at over 300 strokes per minute, leading to increased friction, heat and wear. Conventional pumps operate at high decibel levels, which is a major issue when working around people. No known positive displacement pump can pump a wide variety of liquids without frequent changes of pistons, sleeves and other components.

It follows that there is room for improvement of conventional positive displacement pumps.

EP-0 419 695 A1 discloses a slurry pumping apparatus comprising two side-by-side diaphragm-type pumping units. Each pumping unit comprises a hydraulic cylinder integral with and superimposed on a diaphragm-type pumping cylinder. The hydraulic cylinders each have a double piston arrangement and are connected between the pistons to alternately and repetitively deliver slurry from a slurry tank into processing equipment via the pumping cylinders.

SUMMARY OF THE INVENTION

According to the Invention, there is provided a hydraulically driven diaphragm pumping machine ("pump"), in particular for pumping water and difficult-to-pump materials, the pump comprising at least two pumping units which are placed side-by-side one another. Each pumping unit comprises a hydraulically-driven pump cylinder and a hydraulic drive cylinder which is separate from and is located outside the pump cylinder, the hydraulic drive cylinder and the pump cylinder being placed side-by-side.

The hydraulically-driven pump cylinder has a lower first end with a first inlet and outlet for fluid to be pumped and an upper second end with a second inlet and outlet for hydraulic fluid. The pump cylinder contains a bellows closed at its lower end and open at its upper end for communication with hydraulic fluid, the outside of the bellows defining a space for fluid to be pumped. The bellows of the pump cylinder is arranged to be driven by the hydraulic fluid in concertina-like expansion and contraction to pump the fluid to be pumped adjacent the lower first end of the pump cylinder.

The hydraulic drive cylinder placed beside the pump cylinder has a lower first end associated with a hydraulic drive and an upper second end containing hydraulic fluid communicating with the upper second end of the pump cylinder. The hydraulic drive terminates at its upper end with a drive piston slidably mounted in the hydraulic drive cylinder for driving the hydraulic fluid at the upper end of the hydraulic drive cylinder.

The hydraulic drives of the hydraulic drive cylinders of the two pumping units are connected by a hydro-mechanical connection arranged to control drive of the hydraulic fluid to advance and retract the pistons of each hydraulic drive cylinder.

The side-by-side arrangement of the inventive pumping units and of its hydraulically-driven pump cylinders and hydraulic drive cylinders differs fundamentally from the arrangement of U.S. Pat. No. 8,096,785 wherein the hydraulic drive is located above the pumping units and each pumping unit comprises a hydraulic drive cylinder with a first bellows, the hydraulic drive cylinder being integral with and superimposed upon another part of the pump cylinder fitted with a second bellows. In the present invention, the hydraulic drive cylinder is a non-pump cylinder in the sense that it does not directly pump the material being pumped inside the hydraulic drive cylinder itself, but it nevertheless drives the hydraulically-driven pump cylinder which itself pumps the material.

The hydraulically driven diaphragm pumping machine of the present invention has several advantages over prior pumps and in particular over prior two-bellows pumps:

It has a very simple construction: few pistons, no liners, no crankshaft.

There are very few moving parts and few parts in friction. Moreover, it needs only one bellows in each pump cylinder.

The pump is modular allowing easy modification of pressures/volumes by adding cylinders.

Thanks to the use of a hydraulic piston cylinder combined with a separate bellows pump-cylinder, it is possible to work from zero bar inlet pressure without an additional booster pump. The piston-cylinder unit takes care of all the additional stress associated with the need to increase the pressure in the hydraulic system to ensure secure and smooth operation of control valves and the hydraulic piston cylinder.

It also permits the pump operation to be controlled by a mechanical switch-valve, without the use of electronics. This simplifies construction and improves reliability, serviceability and longevity.

The use of the piston with its hydraulic drive outside the bellows allows to fully protect the actuator fluid against the negative impact of water in the unlikely event of bellows damage. This ensures that water cannot get into oil actuator under any circumstances. The hydraulic drive cylinders work on pure oil and have lightweight pistons so they are hydraulically balanced and are consequently low-cost.

The hydraulic transmission from the piston in the hydraulic drive cylinder to the bellows cylinder piston permits to reduce the mechanical loads under tension and compression as its moving force causes a slight excess pressure that is evenly distributed over the entire bellows surface.

The differential pressure required to move the bellows in expansion/compression is measured in hundredths of bar, so the bellows are almost always in a balanced state and do not experience undue stress under tension or compression.

The bellows cylinder construction provides minimal bellows loads since all its surface is constantly in a hydraulically balanced state. Calculations show that for stretching and compression of bellows of elastomers with a wall thickness of 2-3 mm, an overpressure measured in hundredths of a bar is enough. This pressure drop is virtually independent on the total operating pressure.

The bellows is in a vertical position in normal operation. Oil feeding from the top into the bellows, and the flow of pumped fluid from below and outside the bellows—between the bellows and the inner wall of the cylinder—enables easy removal of air from both the oil and the pumped fluid out through a lateral hole in the cylinder wall. Furthermore, the pumped fluid supply at the bottom of the bellows cylinder provides good removal of dust contained in the fluid from the cylinder.

All valves are mechanically operated and do not require electronic steering, leading to increased reliability.

It can be used as a pressure pump and as a suction pump at the same time.

There is no need for a booster pump. The pump can be self-priming pump and operate from almost zero bar at the pump inlet without an additional booster pump. This simplifies construction and improves reliability.

It is smooth running, even smoother that the best two-bellows pumps.

It can have a very low cycle time of about 8 to 15 strokes/minute, say 10 strokes/minute reducing friction and wear, hence leading to a long life.

It is lighter than most conventional pumps making it easily to transport around oilfields and off-shore platforms.

It has very long service intervals whereas conventional pumps have short service levels, especially when major changes in volume or pressure are required, or when contaminated fluids are being pumped.

It is easy to build and to maintain and is very flexible in its operation.

It is easy to adapt to any support and any dimensions and can easily be scaled up to a multi-unit pumping machine. It has a much smaller "footprint" (dimensions) than conventional pumps, with easy transportation around oilfields and off-shore platforms.

The bellows are much less stressed at equal pressure.

The inside of the bellows cylinder can be easily coated according to the material being pumped, for example according to its abrasive nature or acidity. Coating materials include bronze, ceramics and special steels, for example. The bellows can be made of natural or synthetic rubber coated according to the material being pumped.

The pump is almost silent when operating.

The pump provides continuous flow as part of the normal operational design, eliminating pulsation and cavitation.

There is instantaneous control of the flow rate over a complete range from 0 to maximum, and instantaneous control of the pressure over the complete range from 0 to maximum, without a need to stop the pump and change piston sizes or speed.

The pump can pump almost any liquid, including liquid CO2 and chemicals, polymers, dilute acids and corrosive liquids.

There is a completely closed hydraulic circuitry.

BRIEF DESCRIPTION OF THE DRAWINGS

The invention will be further described with reference to the accompanying drawings, in which.

DETAILED DESCRIPTION

Figure 1:
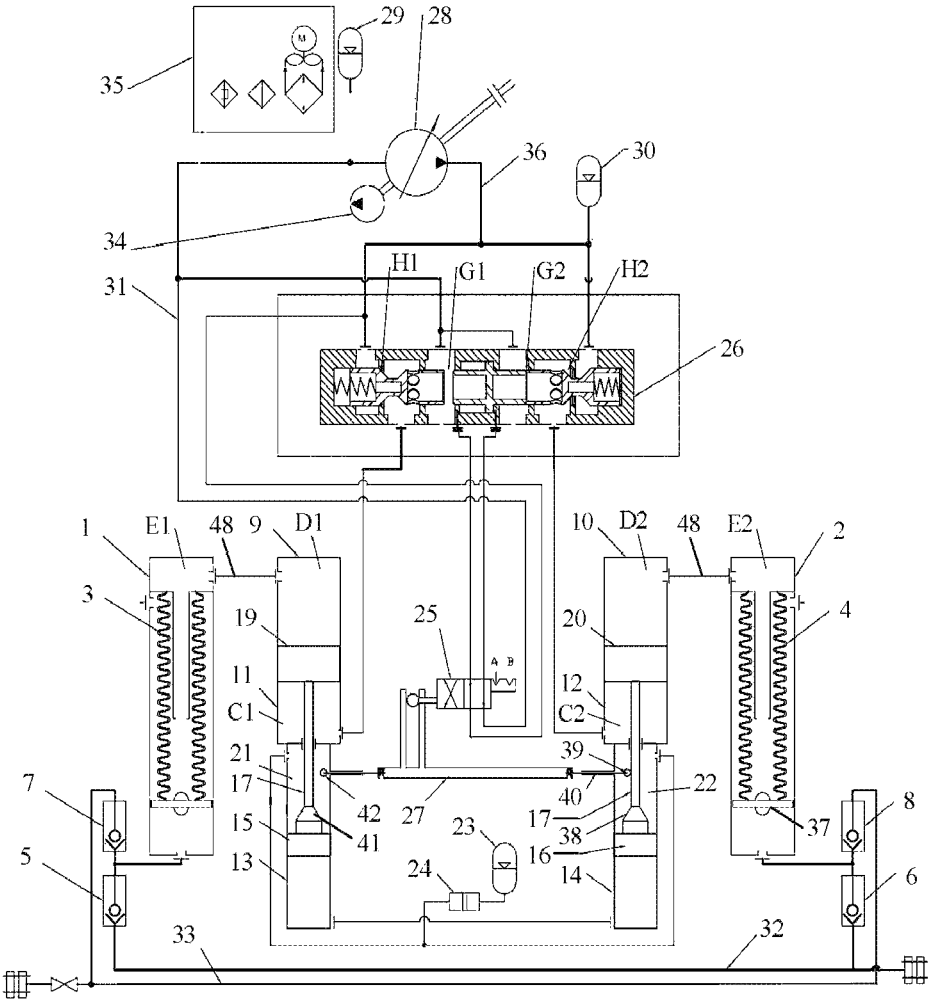
FIG. 1 is an overall schematic diagram of an exemplary embodiment of a pump according to the invention.

The invention provides a hydraulically driven diaphragm pumping machine ("pump"), in particular for water and difficult-to-pump materials. In this example, the pump comprises two side-by-side pumping units but multiple pumping units are possible. Each pumping unit comprises a hydraulically-driven pump cylinder or bellows cylinder 1,2 and a separate hydraulic drive cylinder 9,10 located side-by-side to the pump cylinder 1,2, as shown.

The pump cylinder or bellows cylinder 1,2 has a lower first end with a first inlet and outlet for fluid to be pumped and an upper second end with a second inlet and outlet for hydraulic fluid. In either case, there can be a single inlet/outlet or a separate inlet and outlet. The pump cylinder 1,2 contains a bellows 3,4 closed at its lower end and open at its upper end for communication with hydraulic fluid. The outside of the bellows 3,4 defines a space for fluid to be pumped. The bellows 3,4 of the pump cylinder 1,2 is arranged to be driven by hydraulic fluid supplied at its top end, in concertina like expansion and contraction to pump the fluid to be pumped adjacent the lower first end of the pump cylinder 1,2.

The hydraulic drive cylinder 9,10, placed side-by-side the pump cylinder 1,2, has a lower first end associated with a hydraulic drive and an upper second end containing hydraulic fluid communicating with the upper second end of the pump cylinder 1,2. The hydraulic drive terminates at its upper end with a drive piston 19,20 slidably mounted in the hydraulic drive cylinder 9,10. The hydraulic fluid at the top of the hydraulic drive cylinder 9, 10 is located above the drive piston 19,20 to be driven thereby.

The hydraulic drives of the hydraulic drive cylinders 9,10 of the two pumping units are connected by a hydro-mechanical connection 25,27 designed to control the drive of the hydraulic fluid to advance and retract the pistons 19,20 of each hydraulic drive cylinder 9,10.

At their tops, the pump or bellows cylinder 1,20 and the adjacent hydraulic drive cylinder 9,10 are connected by a conduit 48 for hydraulic fluid.

Preferably, the hydraulic drive of each hydraulic drive cylinder 9,10 ("first hydraulic drive cylinder") comprises a second hydraulic drive cylinder 13,14 of smaller diameter than the first hydraulic drive cylinder 9,10, located under and hydraulically connected to the first hydraulic drive cylinder 9,10. The drive piston 19,20 is a first piston fitting in the first hydraulic-cylinder 9,10 connected by a rod 17 to a second piston 15, 16 of smaller diameter in the second hydraulic drive cylinder 13,14. The hydraulic drive of the hydraulic drive cylinder 13,14 comprises means 27 for supplying hydraulic fluid to the second hydraulic drive cylinder 13,14 above and below the second piston 15,16 of the second hydraulic drive cylinder 13,14.

In the illustrated embodiment, the two side-by-side pumping units are mounted on a rectangular support 50 with the pump cylinders 1,2 side-by-side on a front part of the support 50 and the hydraulic drive cylinders 9,10 side-by-side on the support 50 behind the pump cylinder 1,2. Of course, the pump can be mounted on supports of any suitable shape and size, and with any suitable layout.

Figure 2:
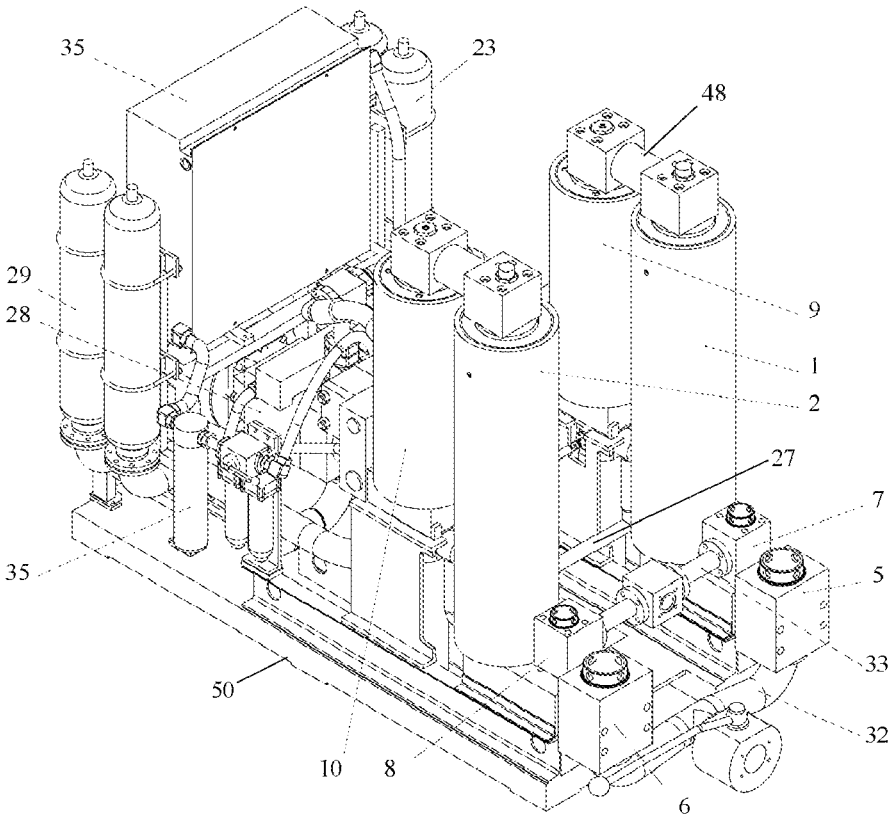
FIG. 2 is a perspective view of the pump of FIG. 1 showing the two pumping units side-by-side.

The pump usually further comprises discharge valves 7,8 and suction valves 5,6 for discharging and inputting material to be pumped out of and into the pump cylinders 1,2. As shown in FIG. 2, the discharge valves and suction valves can be located on the front of the support 50 in front of and at the bottom of the pump cylinders 1,2.

Figure 3:
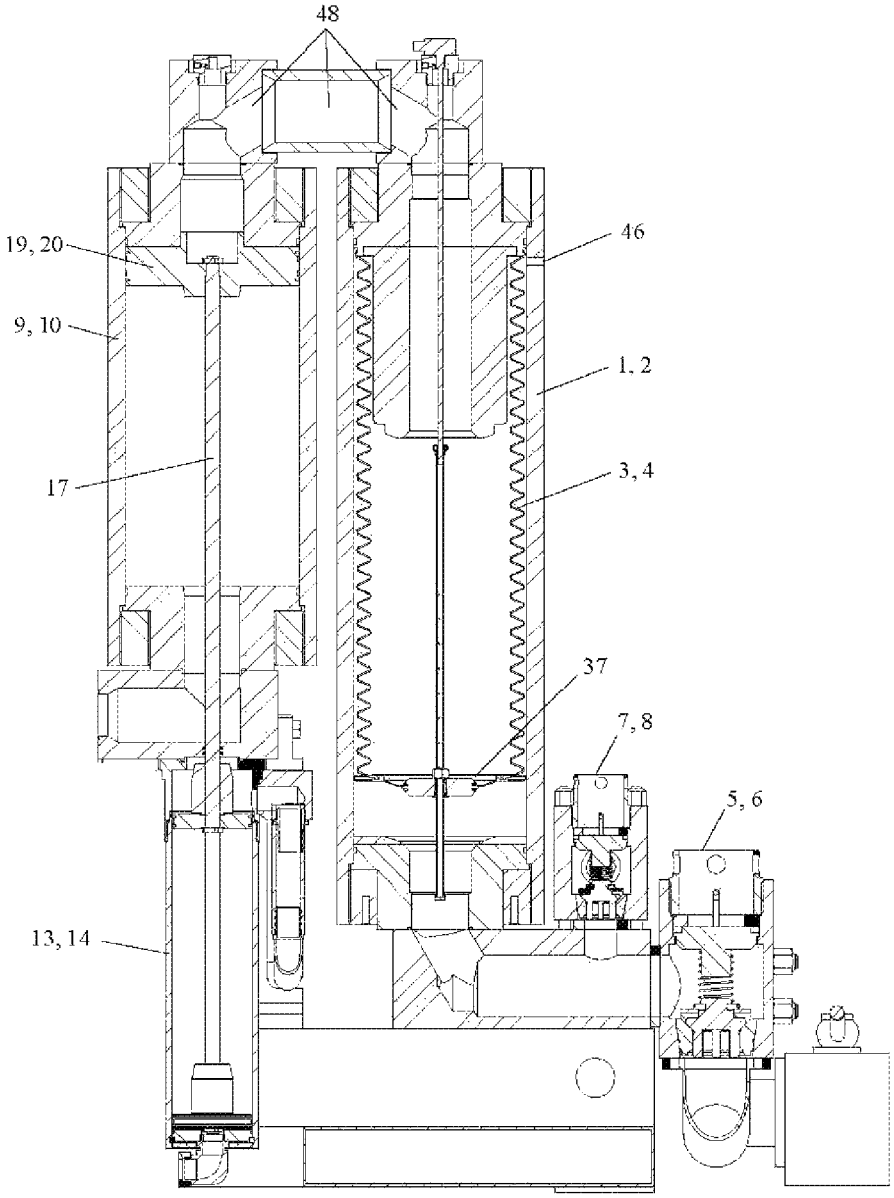
FIG. 3 is a cross-section through the pump cylinder and the hydraulic drive cylinder of one pumping unit wherein the bellows is pushed fully down.
Figure 4:
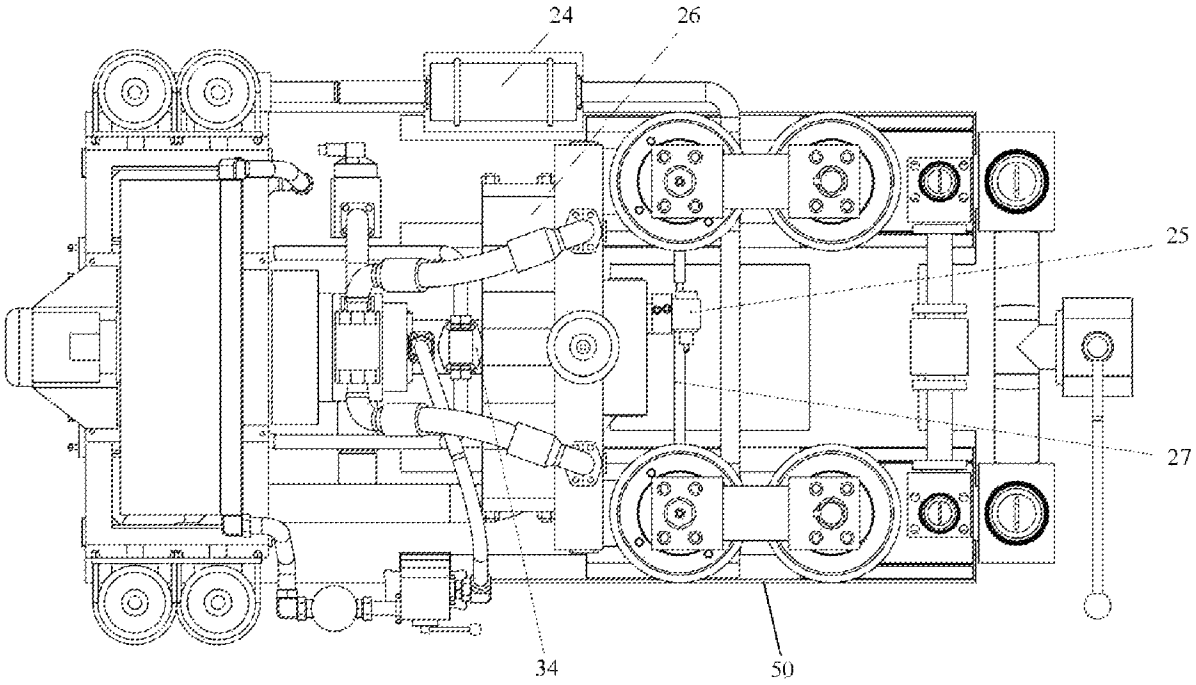
FIG. 4 is a schematic top plan view of the pump.

As shown in FIG. 3, the upper part of the pump cylinder 1,2 can be provided with an air vent 46 for venting air/gas from the material being pumped.

The means for supplying hydraulic fluid to the second hydraulic drive cylinder 13,14 can be a hydromechanical connector 27 located between the hydraulic drive cylinders 9,10 of the two side-by-side pumping units.

In greater detail, the pump consists of two bellows cylinders 1,2 which contain one bellows 3, 4 in each cylinder and two valves: suction valve 5, 6 and discharge valve 7, 8. The pump also has two piston hydraulic drive cylinders 9, 10 hydraulically connected with bellows cylinders 1, 2. Each of the hydraulic drive cylinders 9, 10 comprises a hydraulic power cylinder 11, 12 and a second cylinder 13, 14 whose piston 15, 16 is connected to the hydraulic power cylinder piston 19, 20 by rod 17. Rod end sections 21, 22 of cylinders 13, 14 are hydraulically connected to a common pneumo hydraulic accumulator 23.

The pump also comprises a piston hydraulic fluid control valve 26 connected in cylinder 9,10 below the piston 19,20 and a piston limiter 24 installed between the pneumohydraulic accumulator 23 and hydraulic drive cylinders 13, 14. It also includes a mechanically operated hydraulic power switch 25, hydraulically connected to the hydraulic fluid control valve 26, and mechanically connected by traction rod 27 with the two piston hydraulic drive cylinders 9, 10. The overall pumping machine has a piston hydraulic pump 28 hydraulically connected to the hydraulic fluid control valve 26. The driving power of all units may be either electric, gas or diesel drive (not shown). The pump is supplied with an oil tank in the form of low-pressure accumulator 29 (or reservoir), as well as high-pressure accumulator 30, to alleviate the pressure fluctuations when switching the oil pipeline system 31 and water suction manifold 32 and water delivery manifold 33. For cleaning and cooling oil, the main hydraulic pump 28 is equipped with an auxiliary hydraulic pump 34 and also purification and cooling system 35.

As mentioned, the hydro-mechanical connection 25,27 can be located between the hydraulic drive cylinders 9,10 of the two side-by-side pumping units.

The bellows 3,4 and drive-piston 19,20 of each pumping unit are driven synchronously, and the drive pistons 19, 20 of the two pumping units are driven asynchronously, that is the direction of movement of the pistons 19,20 of the two pumping units does not reverse at the same time.

As illustrated in FIG. 2, the rear part of the support 50 can be occupied by auxiliary equipment like a cooling system (heat exchanger) 35.

The described pump can for example have a maximum operating pressure of say 34.5 MPa, a maximum through flow of at least 500 and possibly 1000 l/min, a minimum absolute pressure upon an input at the maximum productivity of 0.02 MPa, and a power of 200-240 kW. Generally, a pump according to the invention can work at much higher or lower values.

Pump Operation

The pump is connected to water or other fluid material to be pumped which is intaken in the intake manifold 32. The material being pumped is intaken into pumping cylinders 1,2 when the bellows 3,4 moves up under hydraulic drive. When the bellows 3,4 are hydraulically driven down, the pumped material is expelled and is forced out via the discharge manifold 33.

Figure 5:
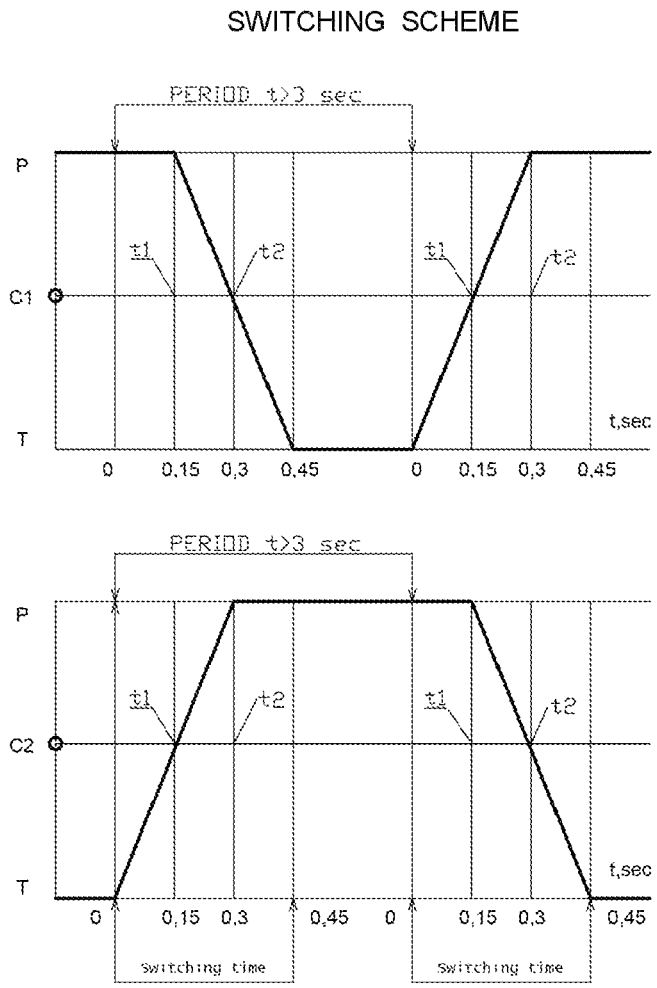
FIG. 5 is a diagram of the scheme of switching.

The mechanically operated hydraulic power switch 25 can be in one of two stable positions «A» or «B». When it is in position «A», high pressure liquid flows from the piston hydraulic pump 28 through the pipeline 36 and the hydraulic fluid control valve 26 to the rod end "C2" of hydraulic power cylinder 12, and moves its piston 20 upward. The fluid from cavity «D2» is expelled into the inner cavity «E2» of bellows 4, moving the partition plate 37 of the latter down. Herewith the pumped fluid is forced out into the manifold 33 through discharge valve 8. The piston 16 of cylinder 14 moves also up forcing the fluid from the rod end 22 of cylinder 14 into the rod end 21 of cylinder 13. The latter in turn, moving down, moves also down the power cylinder 11's piston 19, thus forcing out liquid from its rod end "CI" to the accumulator 29 (or cistern). Under the influence of pressure in accumulator 23, the pistons of cylinder 9 take the lead over the pistons of cylinder 10 in relocation on the value proportional to the volume of piston limiter 24. Owing to this, they reach the end of their power stroke earlier than the cone bushing 38 of piston 16 of cylinder 14 reaches a roller 39 (the start of switching the hydraulic power switch 25 from "A" to "B"). At the start of the switching, the bushing 38 starts to activate the roller 39 moving its rod 40 and rod 27 to the left, leading to switching the hydraulic power switch 25 to position «B», which will hydraulically switch the hydraulic fluid control valve 26. According to the switching scheme shown in FIG. 5, switching of valve 26 takes place in such a way that firstly the drain channel "G1" of cylinder 9 closes, then the inlet channel "HI" of high pressure cylinder 9 opens and high pressure inlet channel "H2" of cylinder 10 closes simultaneously. This ensures smooth switching and minimal pressure oscillations in the pressure manifold 33.

After closing the high-pressure inlet channel H2, the drain channel G2 of cylinder 10 opens. Here the switching process ends. In the period from t1 to t2, see the switching diagram, FIG. 5 which shows the relative switching times of the two cylinders 9,10, when both drain channels G1, G2 are closed, the hydraulic drive pump is powered from the accumulator 29 (or reservoir).

Also in this period, both pressure channels HI, H2 are open and both pistons 19, 20 of power cylinders 11, 12 move upward, the working fluid from cylinders 13, 14 is replaced into hydropneumatic accumulator 23 through piston-limiter 24 which returns to its previous starting position. After opening the drain channel G2 of cylinder 10 the fluid from hydropneumatic accumulator 23 rapidly moves piston 20 of power cylinder 12 downwards under a slight excess pressure. The transfer occurs within the volume of the piston-limiter 24. This ensures asynchronous operation of the two pumping units whereby the final operating position of the working piston 20 of cylinder 12 is earlier than piston 19 of cylinder 11. Later when the bushing 41 of the piston 13 of roller 42 (start of switching), the switching occurs similarly. The asynchronous operation of the two hydraulic drive cylinders can be seen from the switching diagram, FIG. 5.

The invention claimed is:

1. A hydraulically driven diaphragm pumping machine suitable for pumping water and difficult-to-pump materials, the pump comprising at least two pumping units which are placed side-by-side one another, each pumping unit comprising:

a hydraulically-driven pump cylinder (1,2) that has a lower first end with a first inlet and outlet for fluid to be pumped and an upper second end with a second inlet and outlet for hydraulic fluid, the pump cylinder (1,2) containing a bellows (3,4) closed at its lower end and open at its upper end for communication with hydraulic fluid, the outside of the bellows defining a space for fluid to be pumped, the bellows (3,4) of the pump cylinder (1,2) being arranged to be driven by the hydraulic fluid in concertina-like expansion and contraction to pump the fluid to be pumped adjacent the lower first end of the pump cylinder (1,2); and a non-pump hydraulic drive cylinder (9,10) which is separate from and is located outside the pump cylinder (1,2), the non-pump hydraulic drive cylinder and the pump cylinder being placed side-by-side one another, the non-pump hydraulic drive cylinder (9,10) having a lower first end associated with a hydraulic drive and an upper second end containing hydraulic fluid communicating with the upper second end of the pump cylinder (1,2), said non-pump hydraulic drive cylinder (9,10) terminating at its upper end with a drive piston (19,20) slidably mounted in the non-pump hydraulic drive cylinder (9,10) for driving said hydraulic fluid at the upper end of the non-pump hydraulic drive cylinder (9,10), wherein hydraulic drives of the non-pump hydraulic drive cylinders (9,10) of two side-by-side pumping units are connected by a hydro-mechanical connection (25,27) arranged to control the drive of hydraulic fluid to advance and retract the drive pistons (19,20) of both non-pump hydraulic drive cylinders (9,10).

2. The hydraulically-driven diaphragm pumping machine of claim 1, wherein each non-pump hydraulic drive cylinder (9,10) is hereinafter referred to as "first hydraulic drive cylinder", and the hydraulic drive of each first hydraulic drive cylinder comprises a second hydraulic drive cylinder (13,14) of smaller diameter than the first hydraulic drive cylinder located under and hydraulically connected to the first hydraulic drive cylinder (9,10), the drive piston (19,20) being a first piston fitting in the first hydraulic-cylinder connected by a rod (17) to a second piston (15,16) of smaller diameter in the second hydraulic drive cylinder (13,14).

3. The hydraulically-driven diaphragm pumping machine of claim 2, wherein the hydraulic drive of the first hydraulic drive cylinders (9,10) comprises means for supplying hydraulic fluid to the second hydraulic drive cylinder (13, 14) above and below the second piston (15,16) of the second hydraulic drive cylinder.

4. The hydraulically-driven diaphragm pumping machine of claim 1, wherein two side-by-side pumping units are mounted on a support (50) with the pump cylinders (1,2) side-by-side on a front part of the support (50) and the hydraulic drive cylinders (9,10) side-by-side on the support behind the pump cylinders (1,2).

5. The hydraulically-driven diaphragm pumping machine of claim 4, further comprising discharge valves (7,8) and suction valves (5,6) for discharging and inputting material to be pumped out of and into the pump cylinders (1,2), said discharge valves and suction valves being located on the front of the support (50) in front of and at the bottom of the pump cylinders (1,2).

6. The hydraulically-driven diaphragm pumping machine of claim 1, wherein said hydro-mechanical connection (25, 27) is located between the hydraulic drive cylinders (9,10) of two side-by-side pumping units.

7. The hydraulically-driven diaphragm pumping machine of claim 1 wherein the bellows (3,4) and drive piston (19,20) of each pumping unit are driven synchronously, and the drive pistons (19,20) of two side-by-side pumping units are driven asynchronously.

* * * * *